US007438288B2

(12) United States Patent
Nishiberi et al.

(10) Patent No.: US 7,438,288 B2
(45) Date of Patent: Oct. 21, 2008

(54) RECORDING APPARATUS

(75) Inventors: Nozomu Nishiberi, Yokohama (JP); Haruo Uchida, Yokohama (JP); Hiroyuki Saito, Yokohama (JP); Tetsu Hamano, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 548 days.

(21) Appl. No.: 11/187,968

(22) Filed: Jul. 25, 2005

(65) Prior Publication Data

US 2006/0023050 A1 Feb. 2, 2006

(30) Foreign Application Priority Data

Jul. 30, 2004 (JP) ..... 2004-222771

(51) Int. Cl.
*B65H 7/00* (2006.01)
*B65H 5/02* (2006.01)

(52) U.S. Cl. ..... 271/256; 271/272

(58) Field of Classification Search ..... 271/256, 271/272; 399/327; 101/423
See application file for complete search history.

(56) References Cited

U.S. PATENT DOCUMENTS

| | | | | |
|---|---|---|---|---|
| 5,138,390 | A * | 8/1992 | Miyabayashi et al. | 399/111 |
| 5,142,340 | A * | 8/1992 | Farrell et al. | 399/327 |
| 5,154,411 | A | 10/1992 | Saito et al. | 271/289 |
| 5,298,959 | A | 3/1994 | Saito et al. | 355/319 |
| 5,580,042 | A | 12/1996 | Taniguro et al. | 271/274 |
| 5,620,174 | A | 4/1997 | Taniguro et al. | 271/10.12 |
| 5,673,074 | A | 9/1997 | Miyauchi et al. | 347/104 |
| 5,738,453 | A | 4/1998 | Tsuburaya et al. | 400/624 |
| 5,742,318 | A | 4/1998 | Miyauchi et al. | 347/134 |
| 5,902,058 | A | 5/1999 | Koike et al. | 400/578 |
| 5,918,873 | A | 7/1999 | Saito et al. | 271/10.11 |
| 5,984,300 | A | 11/1999 | Nishiberi | 271/171 |
| 6,305,682 | B1 | 10/2001 | Saito et al. | 271/10.11 |
| 6,834,177 | B2 | 12/2004 | Saito et al. | 399/313 |
| 6,877,737 | B2 | 4/2005 | Yanagi et al. | 271/121 |
| 6,923,534 | B2 | 8/2005 | Sai | 347/104 |
| 2003/0052953 | A1 | 3/2003 | Sai | 347/104 |
| 2005/0270353 | A1 | 12/2005 | Nishiberi et al. | 347/104 |
| 2006/0023050 | A1 | 2/2006 | Nishiberi et al. | 347/104 |
| 2006/0024118 | A1 | 2/2006 | Niikura et al. | 400/691 |

FOREIGN PATENT DOCUMENTS

| | | |
|---|---|---|
| JP | 5-238580 | 9/1993 |

* cited by examiner

*Primary Examiner*—David H Bollinger
(74) *Attorney, Agent, or Firm*—Fitzpatrick, Cella, Harper & Scinto

(57) ABSTRACT

A recording apparatus for effecting recording by a recording head on a recording material which is fed by a plurality of pairs of feeding rollers, the recording apparatus, includes a first feeding roller for feeding the recording material with a first feeding force; a second feeding roller for feeding the recording material with a second feeding force which is smaller than the first feeding force; control means for stopping the first feeding roller with a sheet material nipped to cause rubbing between the second feeding roller and the sheet material to effect cleaning to a peripheral surface of the second feeding roller.

6 Claims, 9 Drawing Sheets

RECORDING APPARATUS

FIELD OF THE INVENTION AND RELATED ART

The present invention relates to a recording apparatus which employs one or more recording heads to form an image on recording medium while the recording medium is conveyed by recording medium conveyance rollers. More specifically, it relates to a cleaning means for cleaning the abovementioned recording medium conveyance rollers of a recording apparatus.

Recording apparatuses having the function of a printer, a copying apparatus, a facsimileing machine, and/or the like, recording apparatuses used as the outputting device for a multi-functional electronic device or workstation, which comprises a computer and/or wordprocessor, etc., are structured to form an image on recording media, such as a piece of paper or plastic sheet, according to image formation data. In recent years, digital cameras have come to be widely used. With the widespread usage of digital cameras, recording apparatuses have come to be widely used as a means for printing photographs. When recording a photographic image, the image is usually recorded in the border-less fashion. Thus, various printers capable of recording in the border-less fashion on recording papers different in size, for example, L size, postcard size, A size, etc., are in use.

As the recording method used by a recording apparatus, there are various methods, for example, the ink jet recording method, the thermal transfer recording method, the laser beam illumination recording method, the wire-dot recording method, etc. Among various recording apparatuses employing one of these recording methods, a recording apparatus employing the ink jet recording method, which is advantageous over the others in terms of printing lo speed, running cost, etc., is relatively more widely in use. Further, there are various recording apparatuses employing the ink jet recording method, and they varies in price depending on various factors, for example, resolution, number of inks used for printing, printing speed, etc. In recent years, ink jet printers which are enabled to print on both sides of a printing paper have been gradually spreading, making it possible for even a nonprofessional person to automatically print ordinary documents, web documents, etc., on both sides of a recording medium.

However, the above described recording apparatuses, in particular, ink jet recording apparatuses, which record images on a recording medium by ejecting minuscule ink droplets from ink ejection orifices, have the following technical problems to be solved. That is, not all the ejected ink droplets reach the recording medium surface; some of the ink droplets go astray, turning into ink mist, which floats within a recording apparatus, never reaching the recording medium surface. In particular, when an image is recorded in the border-less fashion, some ink droplets fly into the space outward of the edges of the recording medium, being therefore likely to turn into the ink mist, because of the distance between the edge of the recording medium to a waste ink absorbing member located on the bottom side of the platen. Moreover, as the ink droplets hit the recording medium surface, some of the ink droplets partially splash. Thus, the resultant splashes sometimes turn into ink mist, which floats in the recording apparatus.

With the elapse of time, the ink mist floating in the recording apparatus eventually adheres to some portions of the interior of the recording apparatus. If one of these portions happens to be the peripheral surface of a recording medium conveyance roller, which comes into contact with recording medium, the ink (ink mist) having adhered thereto is transferred onto a recording medium, resulting in the formation of low quality images. In particular, when printing is made on a recording paper of a larger size (A4 size or the like) after printing is made on a substantial number of recording paper of a smaller size (L size, or the like), the ink mist having adhered to the areas of the peripheral surface of the conveyance roller (s), which did come into contact with the recording medium while printing on the smaller recording medium, is sometimes transferred onto the recording medium of a larger size, contaminating the recording medium. This type of contamination of recording medium is considerably more inconvenient when printing on both sides of a recording paper. Therefore, the solution to this problem has been eagerly sought. There is another problem common to various recording apparatuses different in terms of recording method. This problem is that paper dust sometimes adheres to recording medium conveyance roller(s). Thus, as the cumulative hours of the usage of a recording apparatus increases, the amount of the paper dust on the peripheral surface of the conveyance roller (s) becomes substantial, reducing the conveyance roller(s) in conveyance performance, which sometimes results in the formation of images of inferior quality.

SUMMARY OF THE INVENTION

The primary object of the present invention is to provide a recording apparatus in which the ink, paper dust, etc., on its recording medium conveyance roller(s) are removed to minimize the amount of the contamination of a recording medium attributable to the transfer of the abovementioned foreign substances onto the recording medium.

According to an aspect of the present invention, there is provided a recording apparatus for effecting recording by a recording head on a recording material which is fed by a plurality of pairs of feeding rollers, said recording apparatus comprising a first feeding roller for feeding the recording material with a first feeding force; a second feeding roller for feeding the recording material with a second feeding force which is smaller than the first feeding force; control means for stopping said first feeding roller with a sheet material nipped to cause rubbing between said second feeding roller and the sheet material to effect cleaning to a peripheral surface of said second feeding roller.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENT

Figure 1:
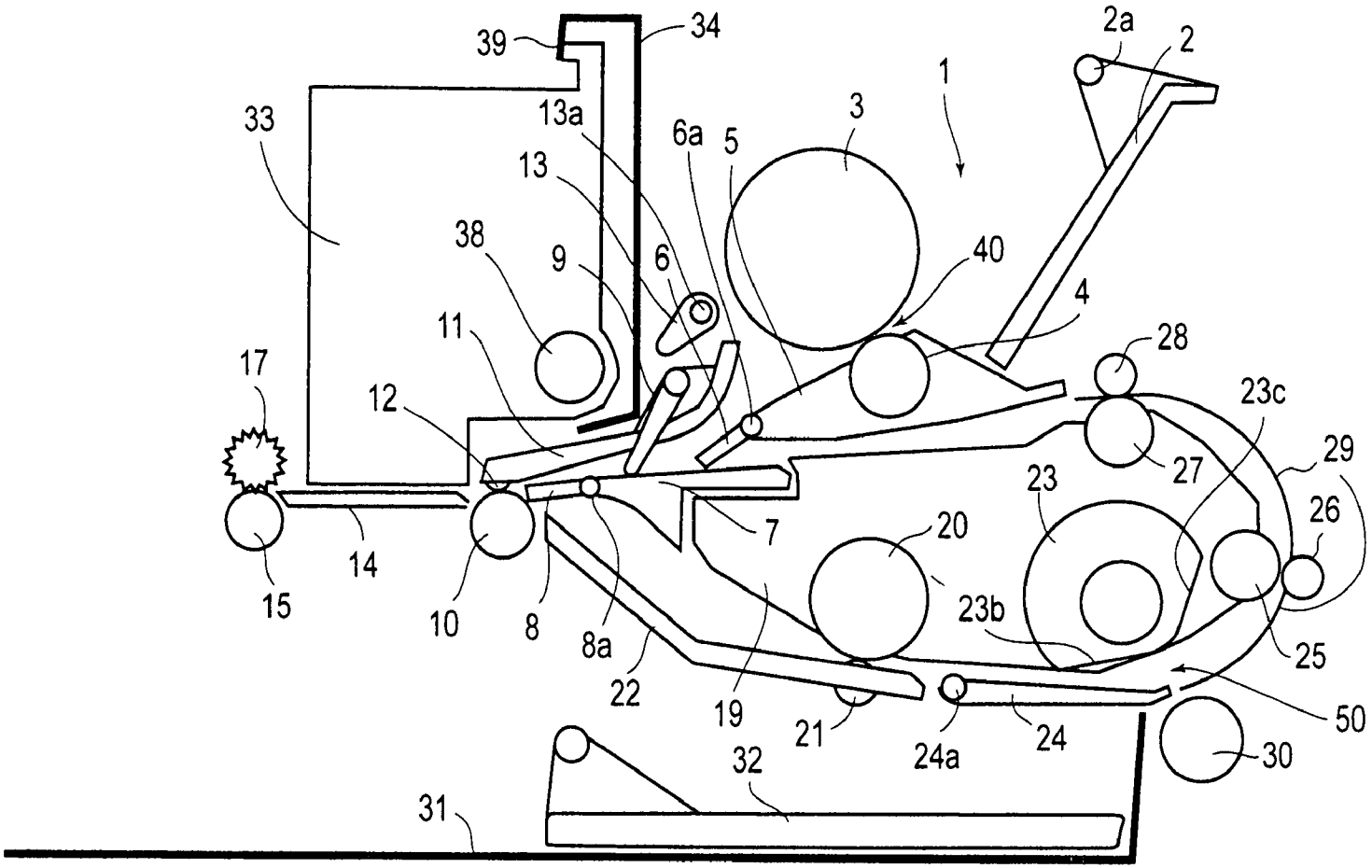
FIG. 1 is a sectional view of the recording apparatus in the preferred embodiment of the present invention, showing the general structure thereof.

Hereinafter, one of the preferred embodiments of the present invention will be described in more detail with reference to the appended drawings. Throughout the following description of the preferred embodiment, if a component in a drawing is identical in referential symbol to a component in another drawing, the two components are virtually identical in function. FIG. 1 is a sectional view of the recording apparatus in an example of the preferred embodiment of the present invention. The recording apparatus in this embodiment is provided with two type of sheet conveying mechanisms, that is, an ASF (automatic Sheet Feeder) located on top of the main assembly, and an ASF which is located in the bottom portion of the main assembly and feeds recording sheets through the U-turn portion of the two-sided printing path, and a mechanism for automatically switching the recording medium path between the single-sided printing path and two-sided printing path. In FIG. 1, a referential symbol 1 designates a sheet tray portion of the top ASF, and a referential symbol 2 designates the pressure plate of the top ASF for keeping the recording mediums pressed on the feed roller of the ASF. In the sheet tray portion 1, recording mediums in the form of a sheet, for example, sheets of recording paper, sheets of plastic film, or the like (which hereinafter may be referred to simply as recording sheet), are placed to be automatically fed. The pressure plate 2 of the ASF is pivotable about the pivotal axis 2*a*.

Designated by a referential symbol 3 is the feed roller of the top ASF, which is for conveying the recording sheets placed on the pressure plate 2, and designated by a referential symbol 4 is the separation roller of the ASF, which is for separating one by one the recording sheets. The nip between the feed roller 3 and separation roller 4 of the ASF constitutes the sheet separating portion of the ASF, which is for separating one by one the recording sheets. Designated by a referential symbol 5 is a first sheet guide for guiding the recording sheet as the recording sheet is sent thereto one by one. Designated by a referential symbol 6 is a first sheet flapper, which is pivotable about the pivotal axis 6*a* , upward or downward to open or close the exit of the U-turn portion of the recording medium conveyance passage, which will be described later. Designated by a referential symbol 7 is a second sheet guide. Designated by a referential symbol 8 is a second sheet flapper pivotable about the pivotal axis 8*a* , upward or downward to open or close the entrance of the U-turn portion of the two-sided printing path. Designated by a referential symbol 9 is a first sheet sensor.

Designated by a referential symbol 10 is a primary sheet conveyance roller, which is disposed on the upstream side of the recording portion, and designated by a referential symbol 11 is a pinch roller holder, which rotatably holds a pinch roller 12 for keeping a recording sheet pressed upon the primary sheet conveyance roller 10. The pinch roller holder 11 is also given the function of guiding a recording sheet to the nip between the primary sheet conveyance roller and pinch roller 12. The pinch roller 12 is kept pressed upon the primary sheet conveyance roller 10 by unshown springs. Designated by a referential symbol 11*a* is the pivotal axle, about which the pinch roller holder 11 pivots, and with which the pinch roller holder 11 is attached to the chassis of the main assembly of the recording apparatus. The pivotal axle 11*a* doubles as the rotational axis of the first sheet sensor 9. Designated by a referential symbol 13 is a pressure removing means for causing the pinch roller holder 11 to pivot in the counterclockwise direction about the pivotal axis 11*a* to eliminate the pressure applied to the primary sheet conveyance roller 10 by the pinch roller 12. The pressure removing means in this embodiment is in the form of a cam, which is rotatable about the rotational axle 13*a* with which it is attached to the chassis of the main assembly of the recording apparatus.

Designated by a referential symbol 14 is a platen for guiding a recording sheet through the recording portion. Designated by a referential symbol 15 is a sheet discharge roller disposed on the downstream side of the recording portion to convey a recording sheet out of the main assembly of the recording apparatus. Designated by a referential symbol 17 is a rowel-like wheel for keeping a recording sheet pressed on the sheet discharge roller 15. Designated by referential symbols 19 and 22 are top and bottom sheet guides, respectively, of the two-sided printing path for recording on the back side of a recording sheet. Designated by a referential symbol 20 is a two-sided printing path roller for pulling a recording sheet, the front surface of which has been printed, into the two-sided printing path in order to print an image on the back side of the recording sheet, and designated by a referential symbol 21 is a two-sided printing path pinch roller for keeping a recording sheet on the two-sided printing path roller 20. The pinch roller 21 is rotatably attached to the sheet guide 22 with a spring-loaded shaft.

Designated by a referential symbol 23 is the feed roller of the bottom ASF which feeds a recording sheet through the U-turn portion of the two-sided printing path, and designated by a referential symbol 30 is the separation roller of the U-turn portion of the two-sided printing path, which is pressed upon the U-turn feed roller 23. The U-turn feed roller 23 and U-turn separation roller 30 constitute a roller pair which feeds recording sheets into the main assembly of the recording apparatus, while separating them one by one, from a cassette 31 which stores multiple recording sheets. The U-turn feed roller 23 is shaped so that its cross section has an arcuate portion, and two contiguous D-cut portions 23*b* and 23*c* for allowing a recording sheet to be conveyed through the two-sided printing path in order to print an image on the back side of the recording sheet. The nip which the U-turn feed roller 23 and U-turn separation roller 30 form between them constitutes the U-turn sheet separating portion for separating recording sheets.

Designated by a referential symbol 24 is a third sheet flapper for switching between the U-turn sheet feeding path and two-sided printing sheet path. The third sheet flapper 24 is pivotally supported so that it can be pivoted about the axial line 24*a* . FIG. 1 shows the state of the recording apparatus, in which the two-sided printing path has no blockage. Designated by a referential symbol 29 is a U-turn sheet feeding guide, which functions as the sheet guide for feeding a recording sheet through the U-turn portion of the two-sided printing path, as well as the two-sided printing sheet conveyance path. Designated by a referential symbol 25 is a first U-turn roller for conveying a recording sheet through the U-turn portion of the two-sided printing path when the recording sheet is fed through the U-turn portion of the two-side printing path, or when forming an image on the back side of the recording sheet, and designated by a referential symbol 26 is a first U-turn pinch roller for keeping a recording sheet pressed upon the first U-turn roller 25. Designated by a referential symbol 27 is a second U-turn roller for conveying a recording sheet through the U-turn portion of the two-sided printing path when the recording sheet is fed through the U-turn portion of the two-side printing path, or when forming an image on the back side of the recording sheet. Designated by a referential symbol 28 is a second U-turn pinch roller for keeping a recording sheet upon the second U-turn roller 27.

In this embodiment, the cassette 31, in which recording sheets are stored to be fed into the main assembly of the recording apparatus through the U-turn portion of the two-sided printing path, is structured so that it can be removably mounted in the main assembly of a recording apparatus. Designated by a referential symbol 32 is a pressure plate for keeping the recording sheets in the cassette 31, pressed against the U-turn feed roller 23. Disposed above the platen 14 is a recording head 33, which is supported by a guide shaft 41 so that it can be reciprocally moved in the primary scanning direction along the guide shaft 41. The guide shaft 41 is supported by the chassis 34 of the main assembly of the recording apparatus. In the case of the recording apparatus shown in this drawing, the recording head 33 is directly supported, being thereby directly guided, by the guide shaft 38 and guide rail 39. However, the recording apparatus may be structured so that the recording head 33 is mounted on a carriage which is supported, being thereby guided, by the guide shaft 38 and guide rail 39. The area between the recording head 33 and platen 14 constitutes the recording portion in which an image is formed on a recording sheet.

Next, the normal operation of the recording apparatus in this embodiment will be described. First, the operation of the top ASF will be described. Recording sheets in the sheet tray portion 1 are kept pressed against the feed roller 3 of the top ASF by the mechanism for raising or lowering the pressure plate 2 of the ASF. Thus, as the feed roller 3 of the ASF is rotated, the recording sheets are fed into the recording apparatus main assembly while being separated one by one by the nip between the separation roller 2 and feed roller 3 of the ASF. In other words, the nip between the feed roller 3 and separation roller 2 of the ASF constitutes the sheet separating portion of the ASF. As the leading edge of a recording sheet reaches the nip (LF nip) between the primary sheet conveyance roller 10 and pinch roller 12 on the upstream side of the recording portion, the recording sheet is guided onto the platen 14 by the rotation of the primary sheet conveyance roller 10.

While the recording sheet is conveyed through the recording portion by the primary sheet conveyance roller 10, recording is made on the top surface (front surface) of the recording sheet. Regarding this recording, an intended image is formed by line by line. That is, while a given portion of the recording sheet is in the recording portion, it is scanned by the recording head 33 in the primary scanning direction, that is, the direction in which the recording head 33 is moved along the guide shaft 41, and each time the recording head 33 is moved in the primary scanning direction, one of the linear portions of an intended image is effected. After the completion of the recording of an image on the recording sheet, the recording sheet is conveyed outward of the apparatus main assembly by the sheet discharge roller 15 and rowel-like wheel 7, which are disposed on the downstream side of the recording portion. The rowel-like wheel 17 is rotated by the rotation of the sheet discharge roller 15.

Figure 2:
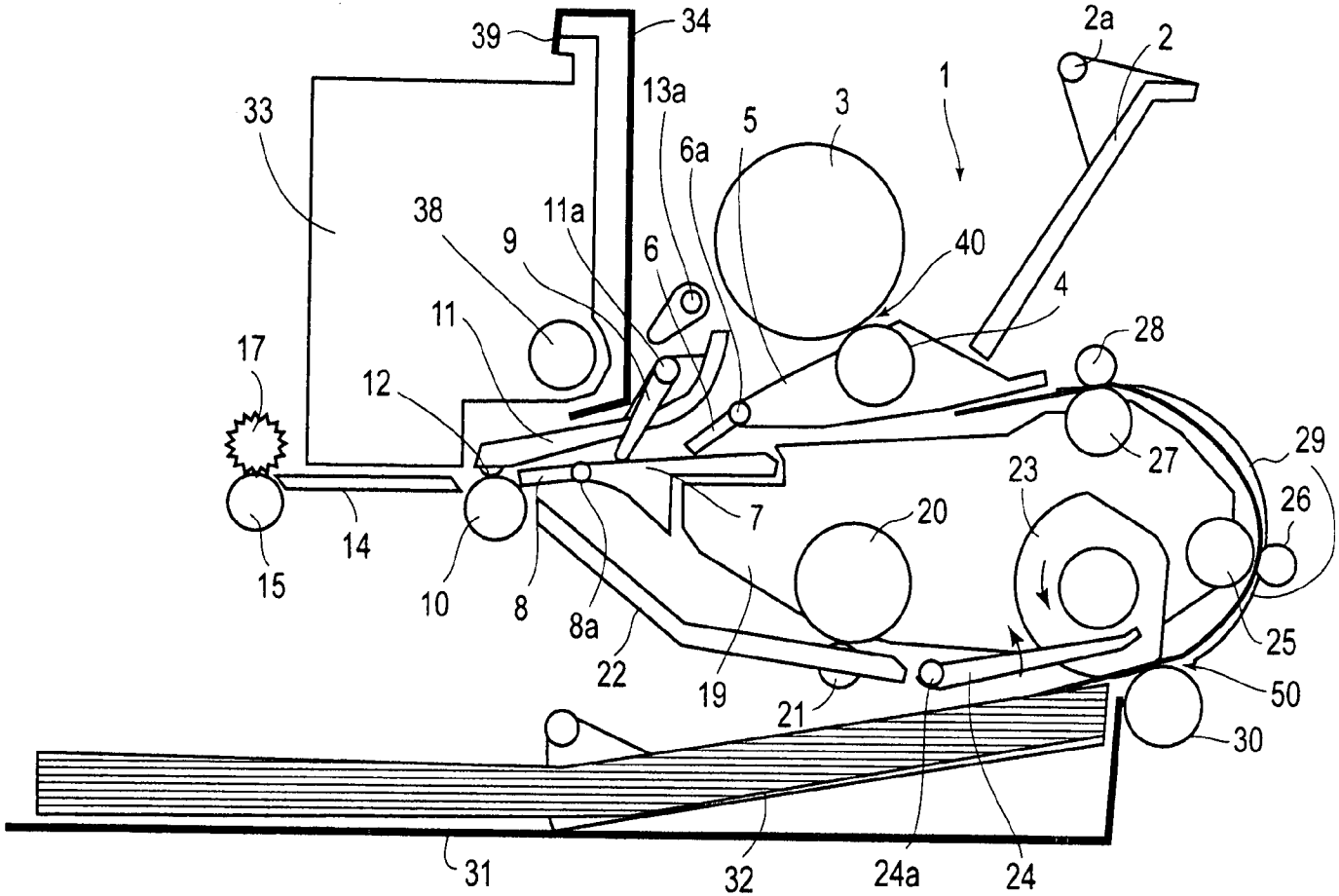
FIG. 2 is a sectional view of the same recording apparatus as the one shown in FIG. 1, in which a recording medium is being conveyed through the U-turn portion of the recording medium conveyance passage.

Next, the U-turn sheet feeding will be described. FIG. 2 shows the state of the recording apparatus shown in FIG. 1, in which a recording sheet is being fed into the main assembly through the U-turn portion of the two-sided printing path. Referring to FIG. 2, the removably mountable cassette 31 contains, in layers, multiple recording sheets, which are to be fed into the apparatus main assembly through the U-turn portion of the two-sided printing path. As the U-turn feed roller 23 is rotated in the counterclockwise direction as shown in the drawing, the U-turn feeding pressure plate 32 is pivoted upward by an unshown driving force transmission mechanism, pressing the recording sheets against the U-turn feed roller 23, and at the same time, the two-sided printing sheet flapper 24 is also pivoted about the pivotal axis 24*a* in the counterclockwise direction, as shown in the drawing, in order to allow the recording sheets to be fed into the U-turn portion of the two-sided printing path. The recording sheets on the pressure plate 32 are fed into the U-turn portion of the two-sided printing path by the rotation of the U-turn feed roller 23 while being separated one by one. In other words, the nip between the U-turn feed roller 23 and U-turn separation roller 30 constitutes the U-turn sheet separating portion 50.

After being released by the U-turn sheet separating portion 50 into the apparatus main assembly while being separated one by one, each recording sheet is conveyed further by the first and second U-turn rollers 25 and 27 as secondary U-turn sheet conveyance rollers, so that it will be placed upside down as it is guided by the U-turn sheet guide 29. Then, as the recording sheet is further conveyed through the U-turn sheet feeding path, which also constitutes a part of the two-sided printing sheet conveyance path, the leading end of the recording sheet moves past the first sheet flapper 6, and then, reaches the LF nip between the primary sheet conveyance roller 10 and pinch roller 12. Thereafter, the recording sheet is conveyed in the same manner as the manner in which a recording sheet is conveyed, as described above, when it is fed from the top ASF. That is, the recording sheet is conveyed through the recording portion by the primary sheet conveyance roller 10, which is on the upstream side of the recording portion, and the sheet discharge roller 15, which is on the downstream side of the recording portion, and while the recording sheet is conveyed through the recording portion, recording is made on the recording sheet.

Figure 3:
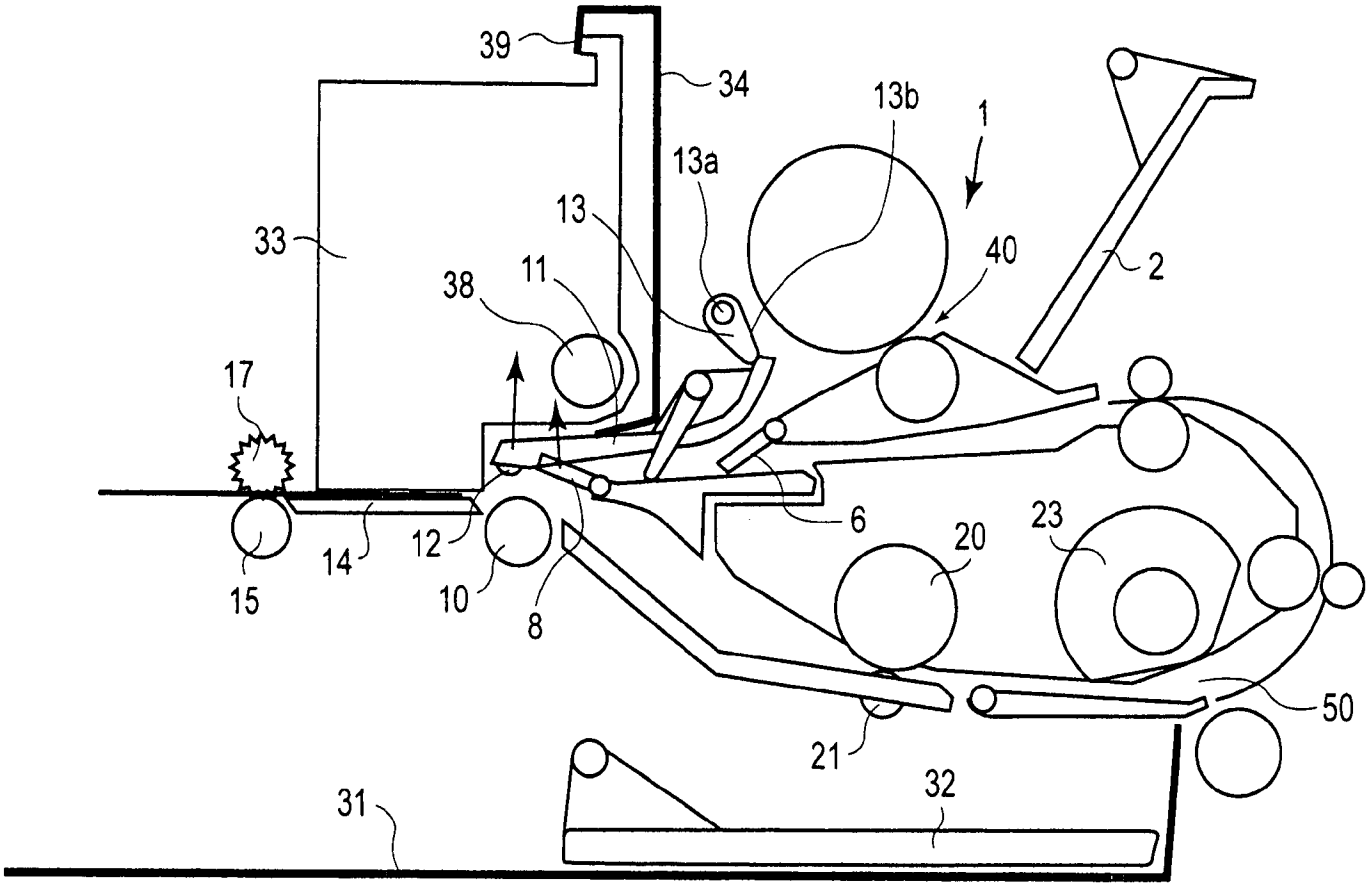
FIG. 3 is a sectional view of the same recording apparatus as the one shown in FIG. 1, which has been set for guiding a recording medium into the two-sided printing path.

FIG. 3 is a sectional view of the same recording apparatus as the one shown in FIG. 1, which has been set for guiding a recording sheet into the two-sided printing path. More specifically, FIG. 3 shows the same recording apparatus as the one shown in FIG. 1, in which after the trailing edge of a recording sheet moved past the LF nip between the primary sheet conveyance roller 10 and pinch roller 12, the pinch roller 12 was separated from the primary sheet conveyance roller 10 to remove the pressure applied thereto by the pinch roller 12, and also, the second sheet flapper 8 had been pivoted upward.

Figure 4:
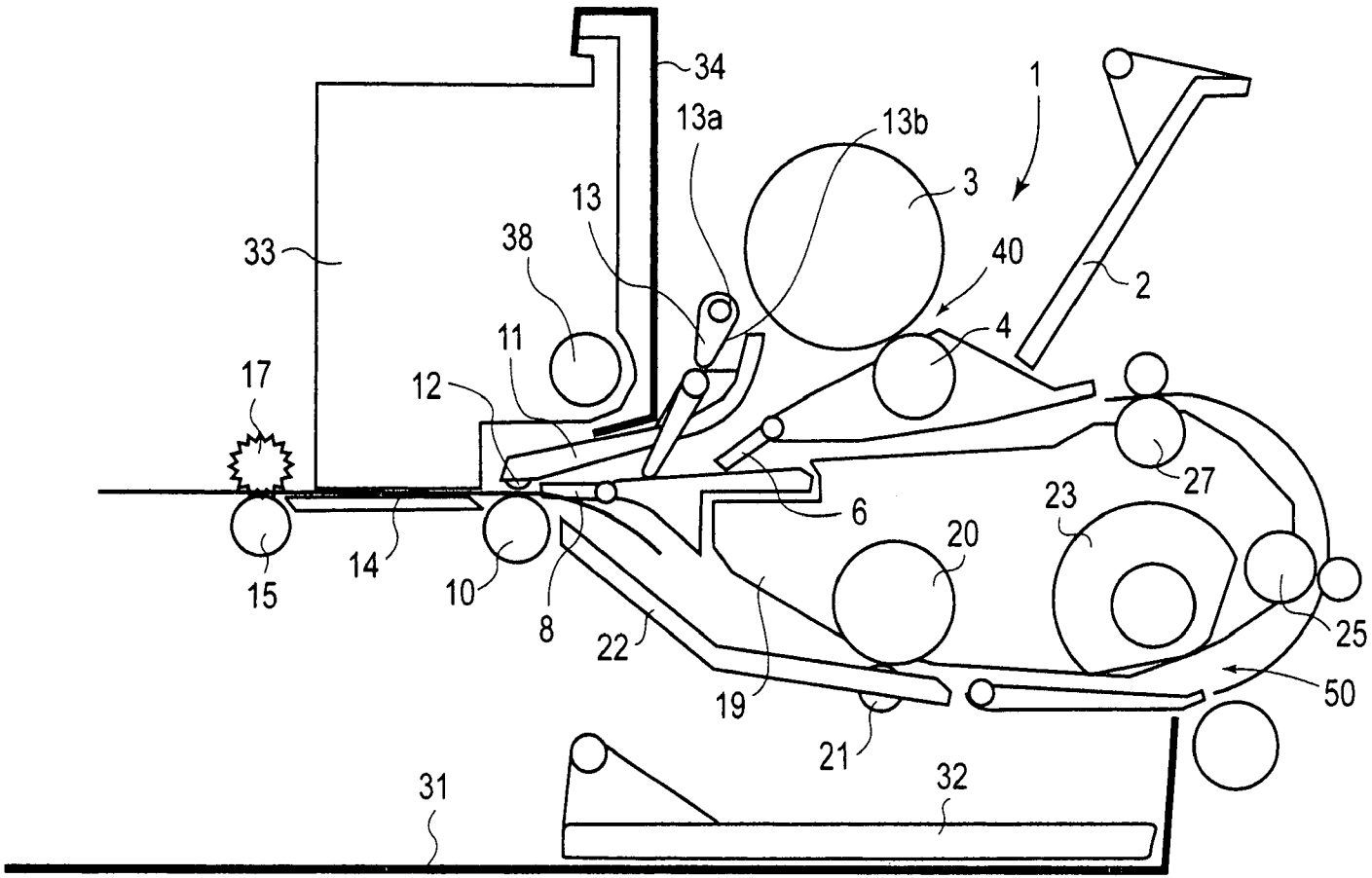
FIG. 4 is a sectional view of the same recording apparatus as the one shown in FIG. 1, in which the leading edge portion of a recording medium has just been guided into the two-sided printing path in order to record an image on the back side of the recording medium.
Figure 5:
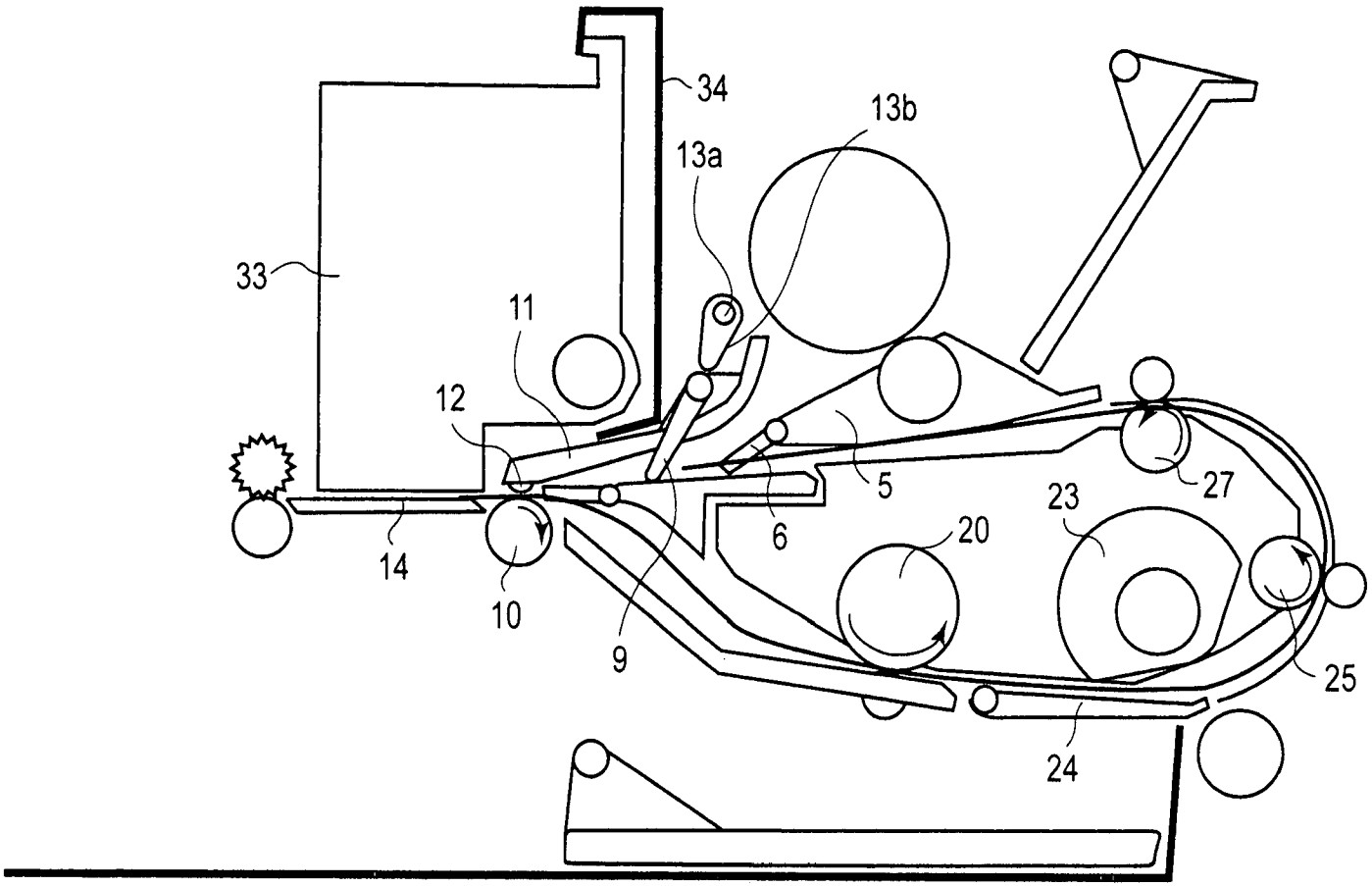
FIG. 5 is a sectional view of the same recording apparatus as the one shown in FIG. 1, in which a recording medium is being conveyed through the U-turn portion of the two-sided printing path in order to record an image on the back side of the recording medium.

FIG. 4 is a sectional view of the same recording apparatus as that shown in FIG. 1, in which the leading end portion of the recording sheet has been made to advance into the two-sided printing path in order to record an image on the back side of the recording sheet. More specifically, FIG. 3 shows the same recording apparatus as the one shown in FIG. 1, in which the sheet discharge roller 15 has begun to be rotated in reverse to make the recording sheet enter the two-side printing path. FIG. 5 is a sectional view of the same recording apparatus as that shown in FIG. 1, in which the recording sheet is being conveyed through the U-turn portion of the two-sided printing path in order to record an image on the back side of the recording sheet. More specifically, FIG. 5 shows the same recording apparatus as that shown in FIG. 1, in which the recording sheet has been pulled into the two-side printing path, and is being conveyed to the recording portion along the two-sided printing path.

Next, the conveyance of a recording sheet through the two-sided printing path will be described. Referring to FIG. 3, after the completion of the printing of an image on the top side (front surface) of a recording sheet, the recording sheet is conveyed backward until the leading edge of the recording sheet, which was the trailing edge of the recording sheet when the recording sheet was conveyed for the image formation on the front surface thereof, comes into contact with the LF nip between the primary sheet conveyance roller 10 and pinch roller 12, which are on the upstream side of the recording portion. As the leading edge of the recording sheet, which was the trailing edge when the recording sheet was conveyed for the image formation on the front surface thereof, is placed in contact with, being thereby jogged against, the LF nip, the recording sheet is corrected in attitude (straightened) and registered. Then, the cam 13 as a pressure removing means is rotated about the rotational axis 13*a* by the combination of a motor and a driving force transmission mechanism, which are unshown. As the cam 13 is rotated, the pinch roller holder 11 is pivoted in the clockwise direction shown in the drawing, by the surface 13*b* of the cam 13. At the same time, the second sheet flapper 8 as the flapper for guiding a recording sheet into the two-sided printing path is pivoted in the clockwise direction, in order to guide the recording sheet into the two-sided printing path (FIG. 3).

As the sheet discharge roller 15 is rotated in the recording apparatus while the recording apparatus is in the state shown in FIG. 3, the recording sheet is conveyed into the two-sided printing path. Then, after the leading end portion of the recording sheet, in terms of the current recording sheet conveyance direction, moves past the gap (which corresponds to LF nip) between the primary sheet conveyance roller 10 and pinch roller 12 by a sufficient distance, the cam 13 as the pressure removing means is rotated in the clockwise direction shown in the drawing to cause the pinch roller 12 to press on the primary sheet conveyance roller 10, as shown in FIG. 4. During this process, the second sheet flapper 8 is pivoted downward by the movement of the pinch roller holder 11, returning to the position shown in FIG. 2. When the sheet flapper 8 is in the position shown in FIG. 2, it is kept in the position by its own weight alone. Therefore, even though it is apparently blocking the two-side printing path, it does not prevent the recording sheet from advancing into the two-sided printing path, because it is kept in the position only by its own weight.

After being conveyed into the two-sided printing path, the recording sheet is further conveyed into the U-turn portion of the two-sided printing path by the reversal rotation of the primary sheet conveyance roller 10 and the two-sided printing path roller 20. Thereafter, the recording sheet is conveyed by the first and second U-turn rollers 25 and 27, as shown in FIG. 5, in the same manner as the manner in which the recording sheet was conveyed after it was fed into the main assembly from the cassette 31 through the U-turn portion of the recording sheet conveyance path. Then, as soon as the leading edge (which was trailing edge when recording was made on front surface of recording sheet) of the recording sheet is moved past the sheet sensor 9, the primary sheet conveyance roller 10 is stopped. Then, the recording sheet is further conveyed to jog the leading end of the recording sheet against the LF nip between the stationary primary sheet conveyance roller 10 and pinch roller 12 so that the recording sheet is corrected in attitude and registered as it was after it was fed into the apparatus main assembly from the cassette 31 through the U-turn portion of the recording sheet conveyance path. Then, the primary sheet conveyance roller 10 and sheet discharge roller 15 located on the upstream and downstream sides, respectively, of the recording portion, are rotated forward to convey the recording medium through the recording portion so that recording is made on the back side (second surface) of the recording sheet.

Thus, the recording apparatus in this embodiment is structured so that it carries out a cleaning operation for removing the contaminants on the peripheral surface of each of the sheet conveyance rollers, as will be described next. As a sheet to be conveyed through the sheet conveyance paths in the recording apparatus in order to clean the sheet conveyance rollers, a sheet dedicated to the cleaning of the sheet conveyance rollers may be used in stead of a sheet of recording paper, a sheet of plastic film, etc.

Figure 6:
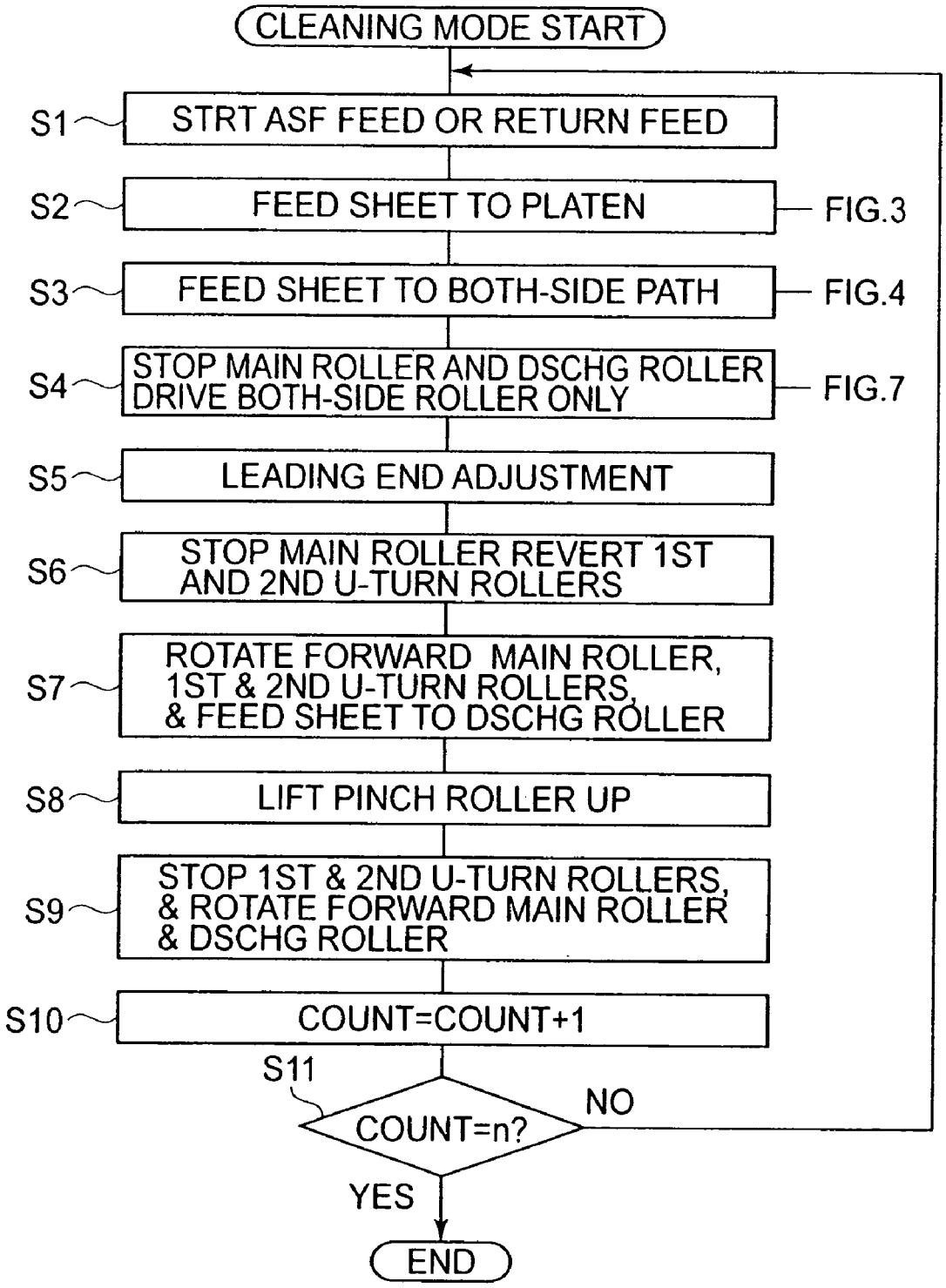
FIG. 6 is a flowchart of an example of the operational sequence for cleaning the recording medium conveyance roller(s) of the recording apparatus shown in FIG. 1.
Figure 7:
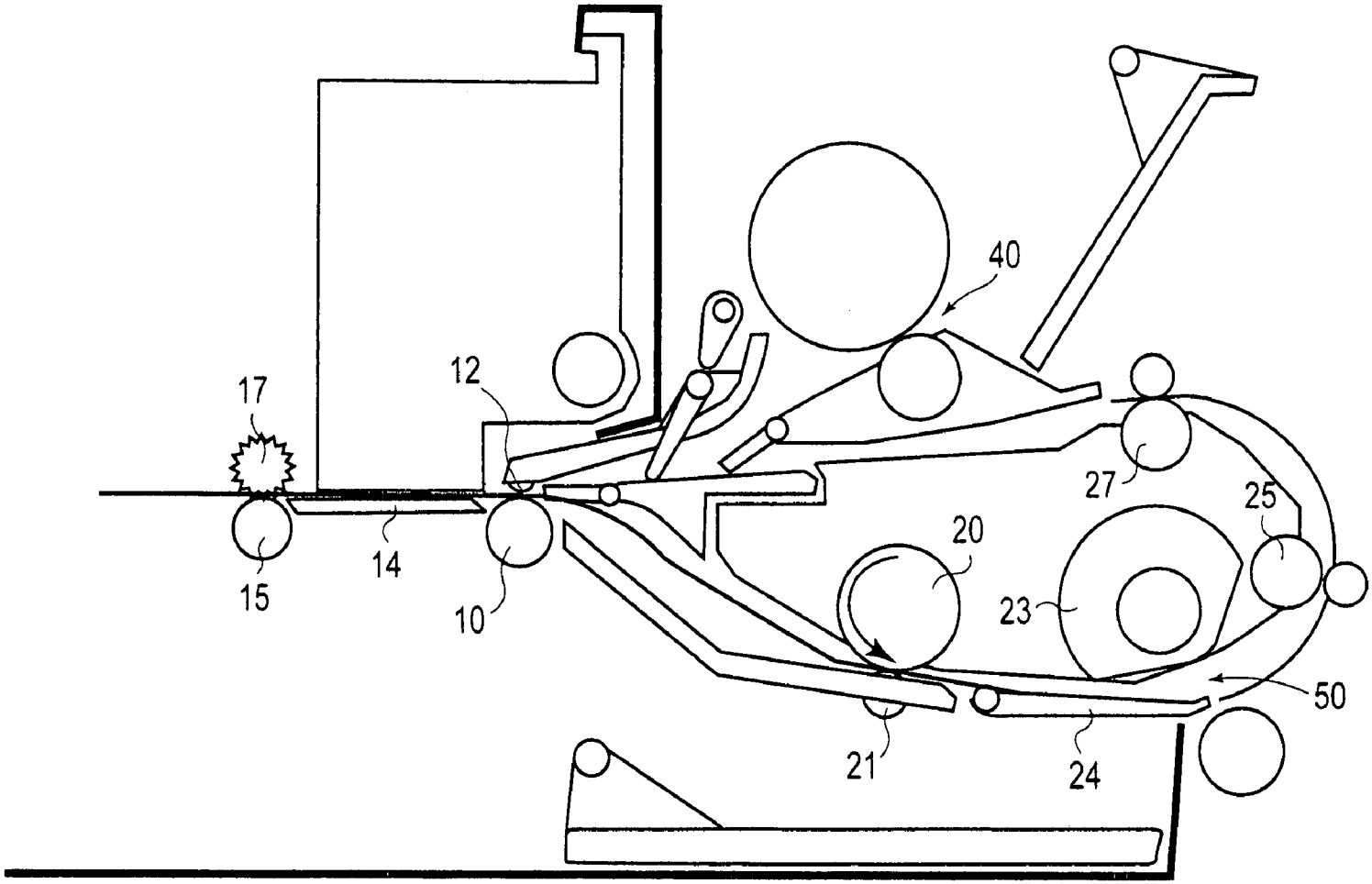
FIG. 7 is a sectional view of the same recording apparatus as the one shown in FIG. 1, in which one of the sheet conveyance rollers of the two-sided printing path is being cleaned.
Figure 8:
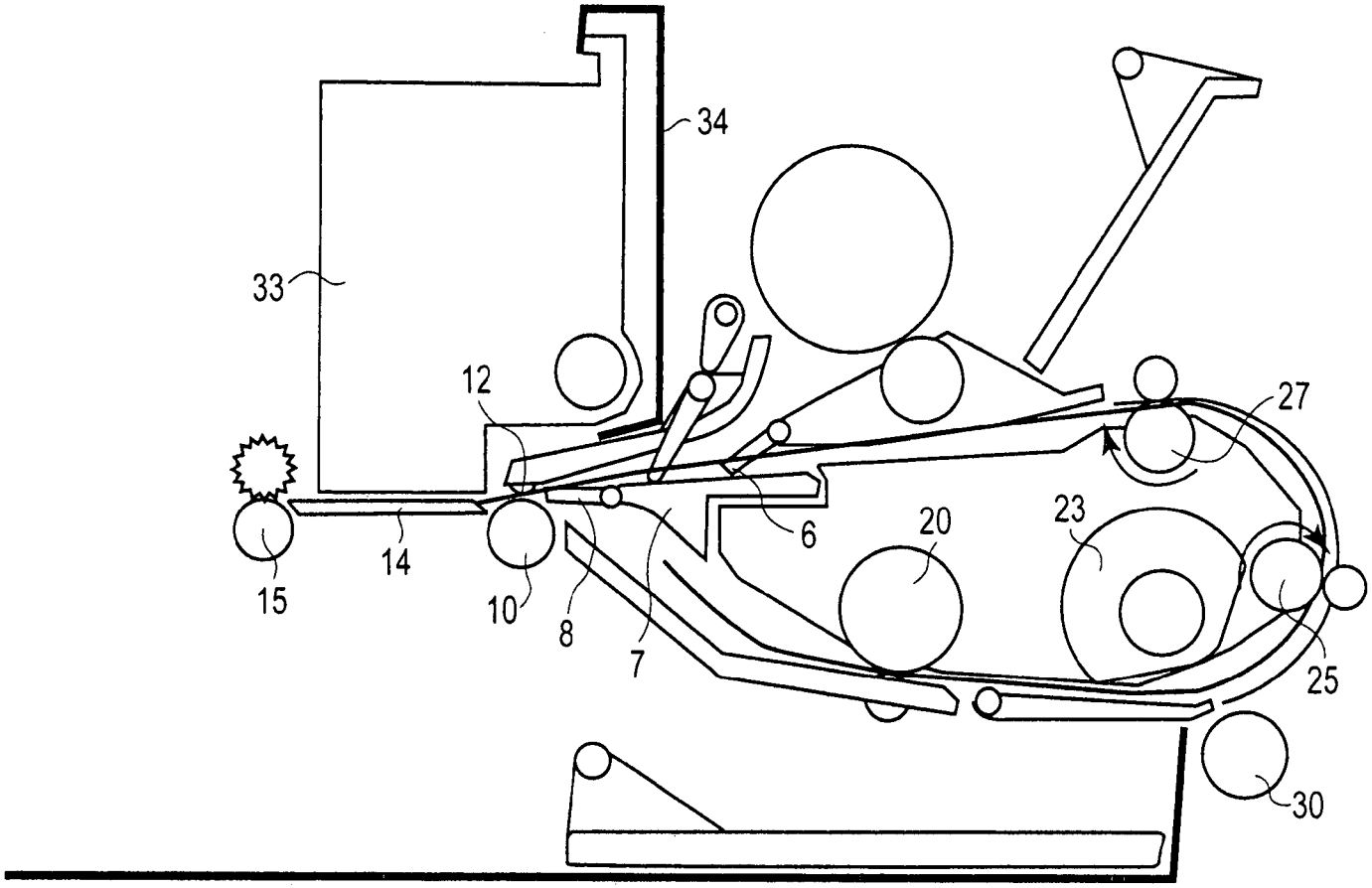
FIG. 8 is a sectional view of the same recording apparatus as the one shown in FIG. 1, in which the secondary sheet conveyance rollers, which are between the primary sheet conveyance roller and the sheet separating portion, are being cleaned.
Figure 9:
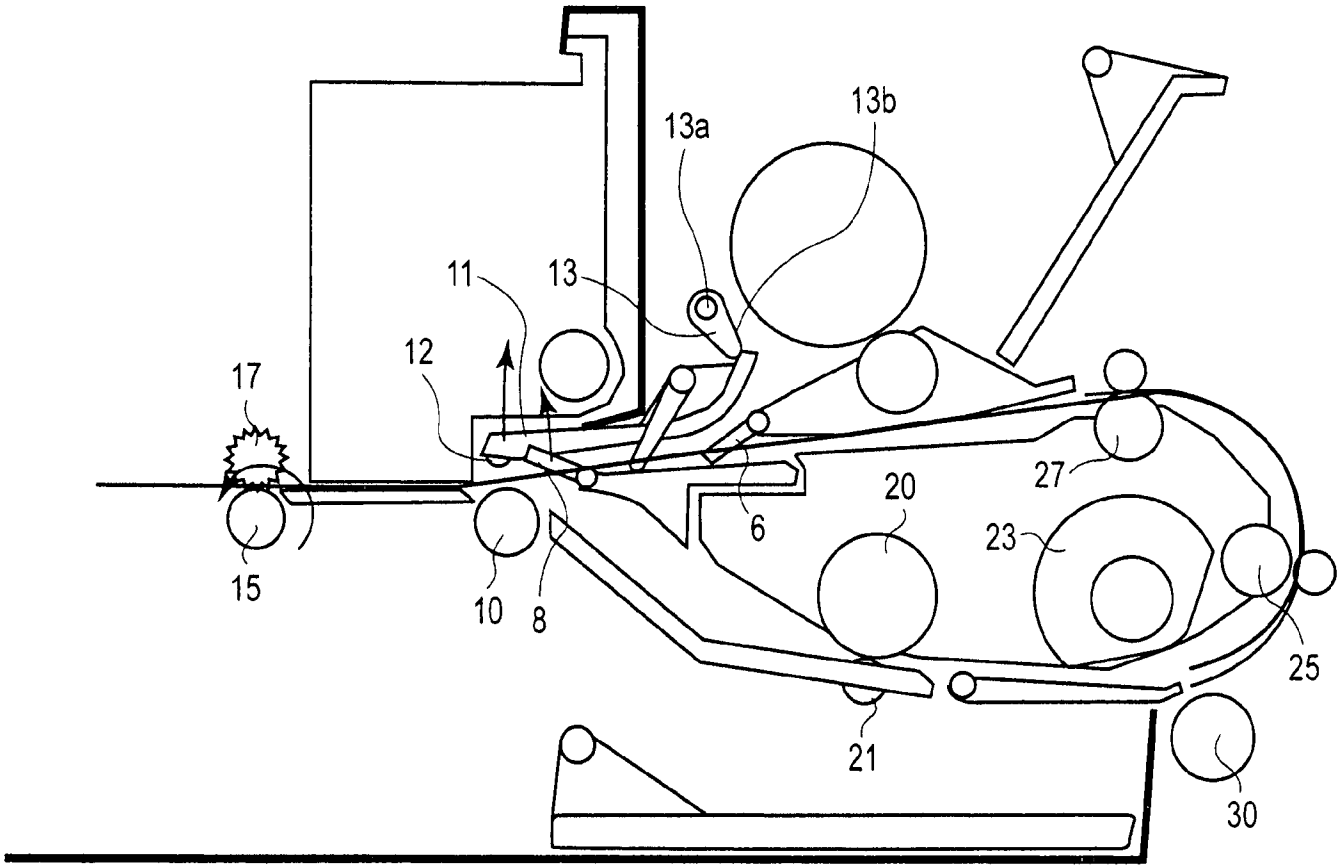
FIG. 9 is a sectional view of the same recording apparatus as the one shown in FIG. 1, in which the sheet conveyance roller located on the downstream side of the recording portion is being cleaned.

FIG. 6 is a flowchart of an example of the sequence for cleaning the various sheet conveyance rollers in the recording apparatus. FIG. 7 is a sectional view of the same recording apparatus as the one shown in FIG. 1, in which the two-sided printing path conveyance roller 20 is being cleaned. FIG. 8 is a sectional view of the same recording apparatus as the one shown in FIG. 1, in which the secondary sheet conveyance rollers (U-turn rollers 25 and 27) located between the primary sheet conveyance roller 10 and the sheet separating portion are being cleaned. FIG. 9 is a sectional view of the same recording apparatus as the one in FIG. 1, in which the sheet discharge roller 15 located on the downstream side of the recording portion is being cleaned.

The recording apparatus shown in FIG. 1 employs, as sheet conveyance rollers, the primary sheet conveyance roller 10, two-sided printing path roller 20, U-turn rollers 25 and 27 (secondary sheet conveyance rollers), and sheet discharge roller 15, which all are sheet conveyance rollers. In terms of the amount of force applied to a recording sheet to convey the recording sheet by each of various sheet conveyance rollers, the primary sheet conveyance roller 10 is the largest among these sheet conveyance rollers. The next largest, that is, intermediate, are the two-sided printing path roller 20 and U-turn rollers 25 and 27, and the sheet discharge roller 15 is the smallest.

Referring to FIG. 6, in order to carry out the cleaning operation, first, a recording sheet, a sheet dedicated to the cleaning of the sheet conveyance rollers, or the like, is to be placed in the top ASF, or the bottom ASF, that is, the ASF which feeds recording sheets through the U-turn portion of the two-sided printing path. Then, as a command for starting the cleaning mode is given to the recording apparatus shown in FIG. 1, the following sequence begins. First, in Step S1, the process of feeding a cleaning sheet or the like in the cleaning mode is started. Next, in Step S2, the sheet is conveyed to the platen 14 (FIG. 3). Then, in Step S3, the pinch roller 12 is separated from the primary sheet conveyance roller 10 (FIG. 3) as it is when a recording sheet is conveyed into the two-sided printing path in order to recording on the back side of the recording sheet, as described above; the sheet is sent into the two-sided printing path by the rotation of the sheet discharge roller 15; the pinch roller 12 is pressed upon the primary sheet conveyance roller 15; and the conveyance of the sheet is started (FIG. 4).

Next, in Step S4, the sheet is conveyed through the two-sided printing path until the leading end of the sheet moves past the two-sided printing path roller 15 by a predetermined distance. Then, the primary sheet conveyance roller 10 and pinch roller 12 are stopped, while keeping the two-sided printing path roller 15 rotating (FIG. 7). As a result, the two-sided printing path roller 15 spins on the sheet, because the amount of grip placed upon the sheet by the primary sheet conveyance roller 10 is greater than the amount of grip which the two-sided printing path roller 15 has on the sheet. In other words, the primary sheet conveyance roller 10, which is greater in the amount of grip upon the sheet, functions as a roller which prevents the sheet from being conveyed, and the two-sided printing path roller 15, which is smaller in the amount of grip upon the sheet, is caused to spin in contact with the sheet, being rubbed (wiped) by the sheet, as shown in FIG. 7.

Consequently, the paper dust having adhered to the peripheral surface of the two-sided printing path roller 15, ink (ink droplets, ink mist, and the like) having dried up after having adhered to the peripheral surface of the two-sided printing path roller 15, etc., are wiped away by the sheet. In other words, the two-sided printing path roller 15 is cleaned. Next, in Step S5, the sheet is conveyed through the two-sided printing path, and the leading end of the sheet is placed in contact with the LF in the same manner as is a recording sheet to be corrected in attitude and registered while the recording sheet is conveyed to be recorded on the back side.

Then, in Step S6, the primary sheet conveyance roller 10 is stopped while the leading edge portion of the sheet, which has just come out of the two-sided printing path, is in the LF nip, that is, remaining pinched by the primary sheet conveyance roller 10 and pinch roller 12, as shown FIG. 8. Then, the first and second U-turn rollers 25 and 27, which are secondary sheet conveyance rollers, are rotated in reverse. As a result, the first and second U-turn rollers 25 and 27 spin in contact with the sheet, as did the two-sided printing path roller 20, because the amount of grip which the primary sheet conveyance roller 10 has on the sheet is substantially greater than that which the first and second U-turn rollers 25 and 27 have on the sheet. In other words, the primary sheet conveyance roller 10, which is substantially greater in the amount of grip upon the sheet, functions as a roller which prevents the sheet from being conveyed, and the U-turn rollers 25 and 27 which are smaller in the amount of grip upon the sheet, are caused to spin in contact with the sheet, being rubbed (wiped) by the sheet, as shown in FIG. 8.

Consequently, the paper dust having adhered to the peripheral surface of each of the U-turn rollers 25 and 27, ink (ink droplets, ink mist, and the like) having dried up after adhering to the peripheral surface of the rollers 25 and 27, etc., are wiped away by the sheet. In other words, the U-turn rollers 25 and 27 are cleaned. Next, in Step S7, which comes after the cleaning of the U-turn rollers 25 and 27, the primary sheet conveyance roller 10 and U-turn rollers 25 and 27 are rotated forward to convey the sheet until the sheet is nipped by the sheet discharge roller 15 and rowel-like wheel 17 located on the downstream side of the recording portion. Then, in Step S8, the cam 13 as the pressure removing means is rotated to separate the pinch roller 12 from the primary sheet conveyance roller 10 as shown in FIG. 3.

Next, in Step S9, the first and second U-turn rollers 25 and 27 are stopped, and the sheet discharge roller 5 located on the downstream side of the recording portion is rotated forward. Since the sheet discharge roller 15 is connected to the same mechanical power source as the primary sheet conveyance roller 10, it is impossible to rotate the sheet discharge roller 15 alone. Therefore, the following operation is carried out in order to clean the sheet discharge roller 15. That is, referring to FIG. 9, the pinch roller 12 is separated from the primary sheet conveyance roller 10, temporarily depriving the primary sheet conveyance roller 10 of its grip on the sheet necessary to convey the sheet. Then, the sheet discharge roller 15 is rotated while the sheet is held in place by the secondary sheet conveyance rollers 25 and 27, which are substantially greater in the amount of grip upon the sheet than the sheet discharge roller 15. As a result, the sheet discharge roller 15 spins in contact with the sheet (FIG. 9).

Consequently, the paper dust having adhered to the peripheral surface of the sheet discharge roller 15, ink (ink droplets, ink mist, and the like) having dried up after adhering to the peripheral surface of the sheet discharge roller 15, etc., are wiped away by the sheet. In other words, the sheet discharge roller 15 located on the downstream side of the recording portion is cleaned. After the cleaning of the sheet discharge roller 15, the sheet may be discharged to end the cleaning operation, or if necessary, the above described sequence for cleaning the various sheet conveyance rollers may be repeated several times in order to better clean the rollers.

According to the above described embodiment of the present invention, a recording apparatus which employs a recording head to form an image on a sheet of recording medium while the sheet is conveyed by various sheet conveyance rollers is provided with a minimum of one sheet conveyance roller, which is greater in the amount of grip upon a sheet of recording medium or cleaning medium than each of the other sheet conveyance rollers, so that any of the other sheet conveyance rollers can be spun in contact with the sheet of recording medium or cleaning medium by keeping the sheet stationary by pinching the sheet with the sheet conveyance roller greater in the amount of grip upon the sheet and the pinch roller paired therewith. In other words, the recording apparatus is structured so that the peripheral surface of each of the secondary sheet conveyance rollers can be cleaned by causing the secondary sheet conveyance roller to spin in contact with the sheet of recording medium or cleaning medium, so that the peripheral surface of the roller is rubbed by the sheet. Therefore, the paper dust, ink, etc., having adhered to the sheet conveyance rollers can be relatively easily removed, making it possible to substantially reduce the amount of the contaminants which otherwise would contaminate a recording sheet by transferring onto the recording sheet. Further, the present invention is effective to prevent a recording sheet from being contaminated on the back side, or to reduce the level of the extent to which a recording sheet is contaminated on the back side, in a recording apparatus having a two-sided printing path for recording on the back side of a recording sheet.

Incidentally, the preceding embodiment of the present invention was described with reference to a recording apparatus of the serial type in which recording is made on a sheet of recording medium by moving a recording head relative to the recording sheet in the primary scanning direction. However, the present invention is also applicable to a recording apparatus of the line type in which recording is made on a sheet of recording medium by moving, only in the secondary scanning direction, a recording head which is long enough to extend from one edge of the recording sheet to the other, or to cover the substantial portion of the range between the two edges, in terms of the direction perpendicular to the direction (secondary scanning direction) in which the recording sheet is moved for recording, and such an application brings forth the same effects as those obtainable when the present invention is applied to a recording apparatus of the serial type. In terms of the recording method, generally, the present invention is applicable to a recording apparatus regardless of the recording method it employs. That is, not only is the present invention applicable to an ink jet recording apparatus, but also, a recording apparatus of the thermal transfer type, a recording apparatus of the laser beam illumination type, a recording apparatus of the wire-dot type, etc., and the effects of such an application are the same as those obtainable when the present invention is applied to an ink jet recording apparatus.

Further, in terms of the recording head count, the present invention is equally applicable with equal effects whether a recording apparatus to which the present invention is applied is a recording apparatus employing only one recording head, a color recording apparatus employing multiple recording heads different in the color of the ink they use, a gradation recording apparatus employing multiple recording heads which are the same in the color of the ink they use, but are different in ink density, or a multi-functional recording apparatus capable of functioning as any of the preceding recording apparatuses. Moreover, in terms of the structure of the recording head of an ink jet recording apparatus to which the present invention is applied, the present invention is equally applicable with equal effects regardless of the structure of a recording means, structure of an ink container, and positional relationship between the recording means and ink container. That is, not only is the present invention is applicable to an ink jet recording apparatus employing an ink cartridge, that is, an integral combination of a recording means and one or more ink containers, but also, an ink jet recording apparatus in which a recording means is independent from an ink container (ink containers), and is connected to the ink container with an ink supply tube or the like.

According to the present invention, it is possible to provide a recording apparatus in which the ink and paper dust having adhered to a sheet conveyance roller can be removed to reduce the amount of the contamination of a sheet of recording medium attributable to the transfer of the ink and paper dust onto the sheet of recording medium which occurs as the sheet of recording medium is conveyed by a sheet conveyance roller having been contaminated with the ink and paper dust. Further, the present invention is capable of reducing the amount by which a sheet of recording medium is contaminated on the back side, in a recording apparatus having a two-sided printing path.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 222771/2004 filed Jul. 30, 2004 which is hereby incorporated by reference.

What is claimed is:

1. A recording apparatus for effecting recording by a recording head on a recording material which is fed by a plurality of pairs of feeding rollers, said recording apparatus comprising:

a first pair of feeding rollers for feeding the recording material with a first feeding force;

a second pair of feeding rollers for feeding the recording material with a second feeding force which is smaller than the first feeding force; and control means for stopping said first pair of feeding rollers with a sheet material nipped by said first pair of feeding rollers and said second pair of feeding rollers, and for effecting cleaning of said second pair of feeding rollers by rotating said second pair of feeding rollers in such direction as to cause slippage relative to the sheet material.

2. An apparatus according to claim 1, wherein said first pair of feeding rollers are main feeding rollers disposed upstream of said recording head with respect to a moving direction of the recording material, and said second pair of feeding rollers are both-side-printing feeding rollers for reversing the recording material to effecting recording on both sides of the recording material.

3. An apparatus according to claim 1, wherein said first pair of feeding rollers are main feeding rollers disposed upstream of said recording head, said apparatus further comprising a separating portion for separating the recording material, wherein said second pair of feeding rollers are subordinate feeding rollers disposed between said separating portion and said main feeding rollers.

4. An apparatus according to claim 1, further comprising a main feeding roller disposed upstream of said recording head, and a separating portion for separating the recording material, wherein said first pair of feeding rollers are subordinate feeding rollers disposed between said separating portion and said main feeding roller, and wherein said second pair of feeding rollers are sheet discharging rollers disposed downstream of said recording head.

5. An apparatus according to claim 4, further comprising a pinch roller rotatable in press-contact with said main feeding roller, wherein said main feeding roller and said sheet discharging rollers are driven by a common driving source, and said pinch roller is spaced away from said main feeding roller when said sheet discharging rollers are cleaned.

6. An apparatus according to claim 1, further comprising a both-side-recording path for reversing the recording material to effect recording on both sides of the recording material, wherein when the peripheral surfaces of said second pair of feeding rollers are cleaned, the sheet material is fed in said both sides feeding path.

* * * * *